United States Patent [19]

Gundlach et al.

[11] 4,076,315

[45] Feb. 28, 1978

[54] DUST ABATEMENT DEVICE AND METHOD OF DUST ABATEMENT

[75] Inventors: Theodore F. Gundlach, Belleville, Ill.; Arthur L. Hawthorne, St. Clairsville, Ohio

[73] Assignee: Rexnord, Inc., Milwaukee, Wis.

[21] Appl. No.: 169,296

[22] Filed: Aug. 5, 1971

[51] Int. Cl.[2] ..... E21C 35/02

[52] U.S. Cl. ..... 299/64; 55/22; 55/91; 55/230; 55/385 D; 98/50; 261/89; 299/12

[58] Field of Search ..... 261/83, 84, 89, 90; 299/12, 64; 98/50; 55/22, 91, 220, 230, 231, 3, 385 D

[56] References Cited

U.S. PATENT DOCUMENTS

| | | | |
|---|---|---|---|
| 831,275 | 9/1906 | Fries | 261/90 |
| 939,481 | 11/1909 | Dickson | 261/90 |
| 1,982,470 | 11/1934 | Franks | 55/2 |
| 2,059,639 | 11/1936 | Hixon, Sr. | 299/12 X |
| 2,070,920 | 2/1937 | Pray | 299/12 X |
| 2,100,178 | 11/1937 | White | 299/12 X |
| 3,387,889 | 6/1968 | Ziemba et al. | 299/12 |
| 3,474,597 | 10/1969 | Eckert | 55/231 |
| 3,603,644 | 9/1971 | McCleery | 98/50 X |

FOREIGN PATENT DOCUMENTS

| | | | |
|---|---|---|---|
| 1,206,955 | 9/1970 | United Kingdom | 299/12 |
| 209,378 | 3/1968 | U.S.S.R. | 299/12 |

*Primary Examiner*—Frank W. Lutter
*Assistant Examiner*—David L. Lacey
*Attorney, Agent, or Firm*—Cohn, Powell & Hind

[57] ABSTRACT

A dust abatement device including an intake or collecting means for delivering air to a rotating fan constituting a propulsion means, and outlet means directing air from the fan in a curtain at an area of dust concentration to inhibit dust movement out of the area. The intake means includes a duct extending from the fan to the area of dust concentration to pick up and deliver air-borne dry dust particulate from such area to the fan, the fan mixing the dry dust particulate with liquid sprayed on the fan to provide a slurry, and the outlet means directing the air and slurry from the fan to the area of dust concentration so that the slurry further wets the dust particulate at such area. The dust abatement device can be mounted on a machine that includes a mechanism for acting on material in a manner so as to create the area of dust concentration. More particularly, the dust-forming mechanism can be the cutter head of a continuous mining machine that rotates in a direction to cause an air flow rearwardly and upwardly from the area of dust concentration. In this event, the fan delivers the air and slurry in a spray to the cutter head and substantially in a direction counter to the air flow created by the cutter head to retard such flow and movement of the dry dust particulate away from the area of dust concentration.

3 Claims, 5 Drawing Figures

Inventors
THEODORE F. GUNDLACH
ARTHUR L. HAWTHORNE

By Cohn, Powell & Hind
Attorneys

Inventors
THEODORE F. GUNDLACH
ARTHUR L. HAWTHORNE

By Cohn, Powell + Hind
Attorneys

Inventors
THEODORE F. GUNDLACH
ARTHUR L. HAWTHORNE

By Cohn, Powell & Hind
Attorneys

DUST ABATEMENT DEVICE AND METHOD OF DUST ABATEMENT

BACKGROUND OF THE INVENTION

This invention relates generally to improvements in a dust abatement device and to a method of dust abatement, and more particularly to a device of this type that can be used in combination with a continuous mining machine to reduce the area of dust concentration created by the operation of such machine.

The basic function of a dust abatement device (air scrubber or wet dust collector) is, of course, to clean dust and/or contaminated air, and is accomplished in three basic steps. The first step is to convey the dirty air into the device by an air mover which is usually a fan that is any one of several different types, as for example, propeller, radial, squirrel cage and the like or any one of various types of positive displacement air movers. The only requirement is that the air mover be capable of moving the quantity of air desired and at the same time be capable of moving this air against whatever static air pressure is required by the type of device used. Heretofore, moving the air and abating the dust have generally been separate functions.

The second step is to mix the contaminants in the dirty air with a liquid by any one of various means including: (1) merely bubbling the dirty air through a pool of liquid, which is very inefficient. (2) mechanically atomizing the liquid through spray nozzles or other means and dispersing these liquid particles throughout the dirty air, usually in an enclosed compartment, thereby depending on numerous small particles of liquid to mix with or "wet" the particulate matter in the dirty air. This method, in order to obtain any worthwhile mixing efficiency requires a relatively large mixing chamber. (3) injecting the liquid and dirty air into a cylindrical chamber of a cyclone in such a way that the mixture spins around the chamber so that the heavy particulate matter and liquid tend to spin to the outside, mix together and run downwardly to the bottom of the cyclone where it is drained out of the bottom, the lighter air or gas being allowed to escape from the center of the chamber where the centrifugal force has been largely dissipated. Both wet and dry cyclone dust collectors have been used for various purposes, the wet type being referred to previously. Naturally, the higher the velocity of the dirty air entering the cyclone, as well as the smaller diameter of the cyclone tends to increase the collection efficiency of the cyclone. (4) mixing the liquid and the particulate contaminant that is in a gas by so-called "wet plate impingement". In this method, the high velocity of dirty air is directed against a wetted surface, and air is diverted from such surface. The inertia and mass of heavier solid particulate matter tends to make it strike or impinge on the wetted surface and hence be trapped by the liquid. Of course, the smaller and lighter the particulate, the harder such particulate has to be forced into contact with a wet plate and thus be mixed with the liquid. Wet plate impingement can be accomplished in two different ways. The first method is, as mentioned, with stationary plates and using high velocity air movement to provide the necessary inertia force for the particulate. The second method is to move the wet plates at high speed through relatively calm dirty air. Both methods serve the same purpose, that is to mix solid particulate matter (wetting action) with the scrubbing liquid.

The third step necessary in this type of dust abatement device is that the dirty mixture of solid particulate matter and liquid must now be removed from the main air stream, and thereby provide relatively clean air. Many devices heretofore utilized in mines in an attempt to clean up the foul air are of relatively large size and are of awkward shapes and configurations that preclude advantageous location of such devices near the mine face. Such devices are placed in the mine tunnel at a relatively remote location from the mine face behind the continuous mining machine. The heretofore conventional devices do not direct the clean air back toward the mine face, but rather, because of their structure and configuration, serve to direct the clean air rearwardly from the mine face. Moreover, such devices are not adapted to be carried by the continuous mining machine because such is prohibited by the bulk and shape of such devices. There is no provision on the device for permitting such functional and structural cooperation. As a result, such devices fail to cooperate with the mining machine in an effort to save the useful coal dust that is removed from the polluted air and to remove such dust with the mine material to a remote location.

SUMMARY OF THE INVENTION

The present dust abatement device is of a relatively flat, horizontal shape and of compact size so that one or more of such devices can be utilized with the continuous mining machine without increasing the height of the machine beyond the capability of the pivoted and rotatable cutter heads. Of course, the device could be vertical or in any other plane if desired. As a result, the inlets to the dust abatement device can be placed substantially at the mine face where the concentration of the polluted air is the greatest and where the need for treatment is most desirable. Moreover, the present dust abatement device can and does process the polluted air substantially at the mine face and remove the dust.

The dust abatement device is provided with a rotor means that includes a rotating fan constituting a propulsion means, intake or collecting means for delivering air to the fan, and outlet means directing air from the fan in a curtain at an area of dust concentration to inhibit dust movement out of the area. The device can also include a spray means directing liquid on the fan, and in such event, the outlet means directs the air and liquid from the fan in the curtain at the area of dust concentration.

More particularly, the intake means of the dust abatement device includes a duct that extends from the rotor means to the area of dust concentration to pick up and deliver airborne dry dust particulate from the area to the fan, the fan mixing the dry dust particulate with the liquid to provide a slurry, and the outlet means directing the air and slurry from the fan to the area of dust concentration so that the slurry further wets the dust particulate at such area.

The present dust abatement device includes a means that cooperates with the fan to provide a flow passage therethrough, and impingement means located in the flow passage and wetted by the liquid. The dry dust particulate delivered to the fan strikes against the impingement means while moving in a tortuous path along the flow passage and is wetted to form the slurry. The impingement means can consist of fan surfaces that are wetted by the liquid.

The dust abatement device can be mounted on a machine that includes a mechanism for acting on material so as to create the area of dust concentration. When the mechanism causes an air flow pattern, the propulsion means of the dust abatement device delivers the air and slurry in a spray into the air flow to retard such flow and retard movement of the dry dust particulate away from the area of dust concentration. Particularly, a cutter head of a continuous miner rotates in a direction to cause an air flow rearwardly and upwardly from the area of dust concentration. The propulsion means of the dust abatement device, which is located rearwardly of the cutter head, delivers the air and slurry in a spray to the cutter head and substantially in a direction counter to the air flow created by the cutter head.

The method of abating dust comprises the steps of collecting air-borne dry dust particulate from an area of dust concentration, delivering the air and particulate to a propulsion means, spraying liquid on the propulsion means, mixing the liquid and dry dust particulate to provide a slurry, and delivering the cleaner air and slurry by the propulsion means in a spray to the area of dust concentration, the slurry further wetting the dry dust particulate at the area and reducing the concentration. Where the area of dust concentration has a directional air flow, the method includes the step of directing the air and slurry spray substantially in a direction counter to such air flow to retard such flow and movement of the dry dust particulate away from the area of dust concentration.

DETAILED DESCRIPTION OF THE DRAWINGS

DESCRIPTION OF THE PREFERRED EMBODIMENT

Figure 2:
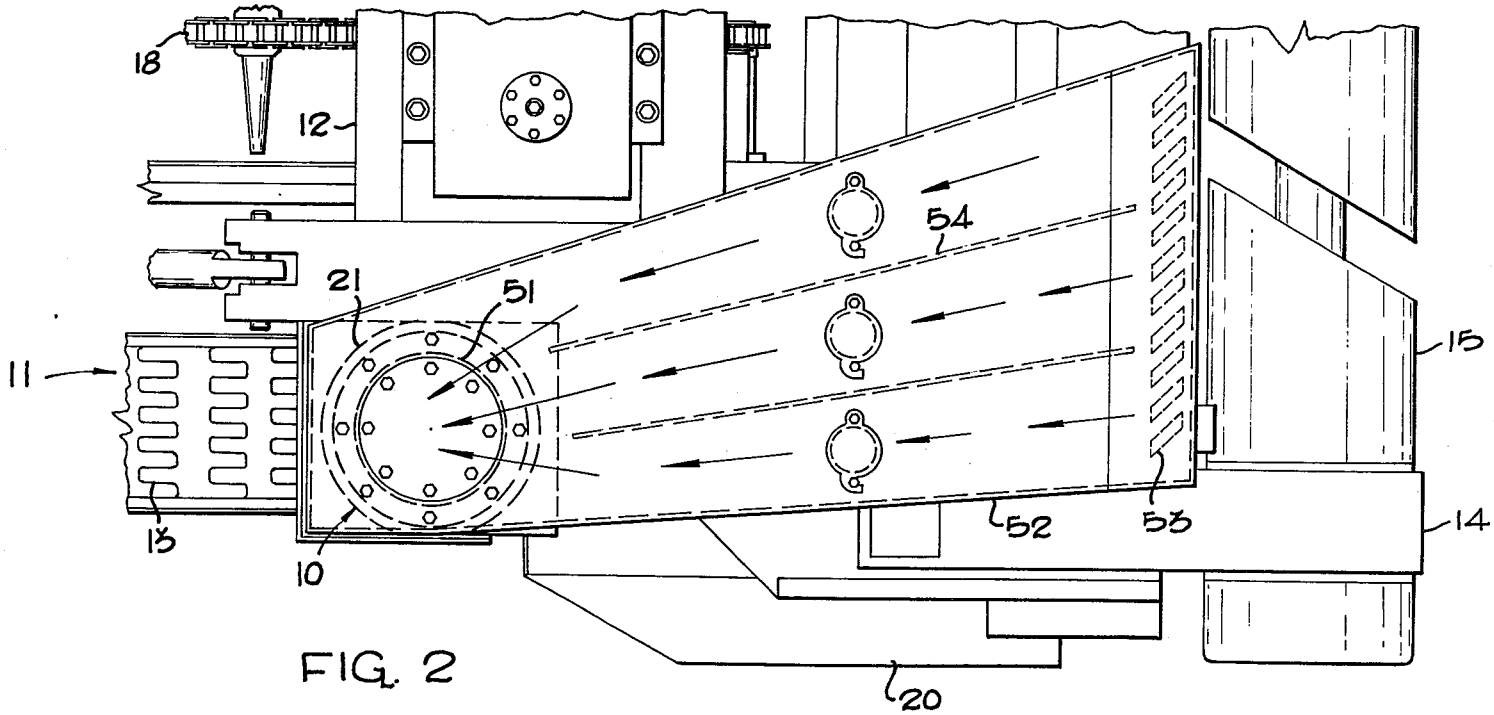
FIG. 2 is a fragmentary, top plan view of the machine and dust abatement device shown in FIG. 1, such view terminating at substantially the longitudinal axis of the machine, it being understood that the other half of the machine is the same and carries another, identically mounted and arranged dust abatement device.
Figure 1:
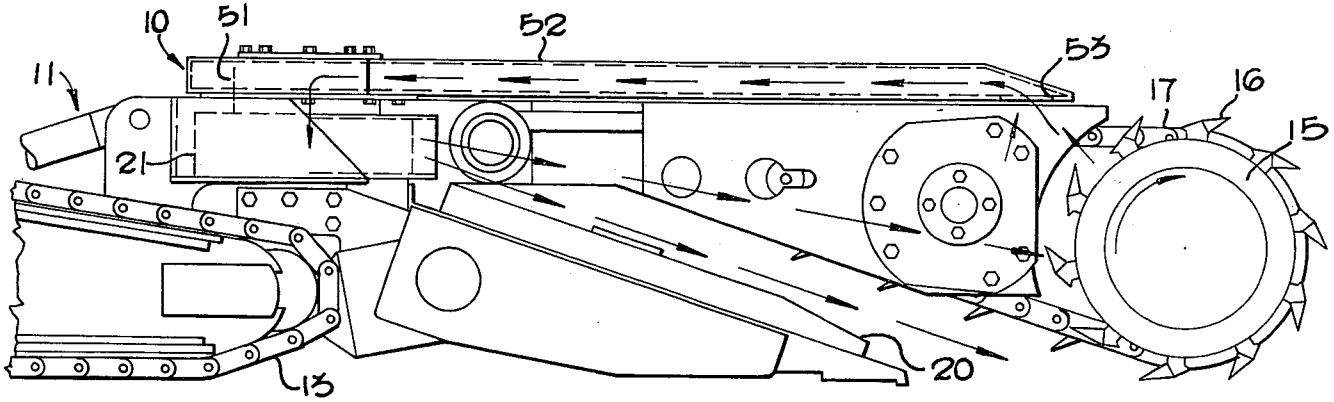
FIG. 1 is a side elevational view of a continuous mining machine with the dust abatement device mounted thereon.
Figure 3:
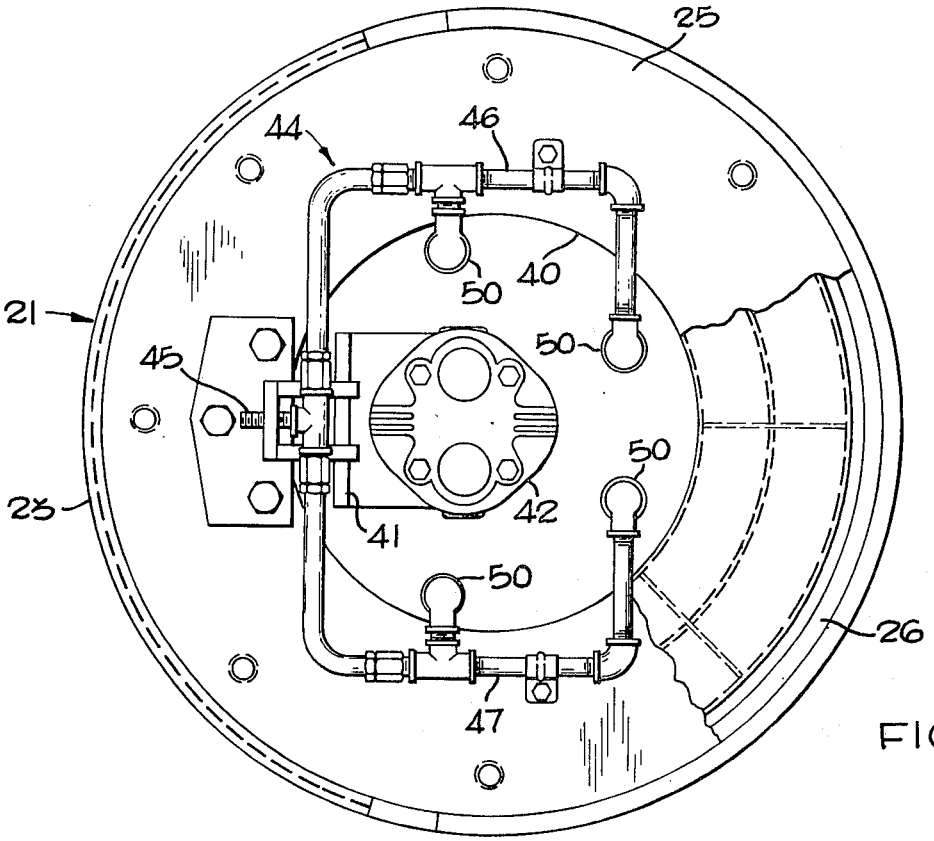
FIG. 3 is a top plan view of the dust abatement device with the intake duct removed, and with the top plate partially cut away to show the internal fan.
Figure 4:
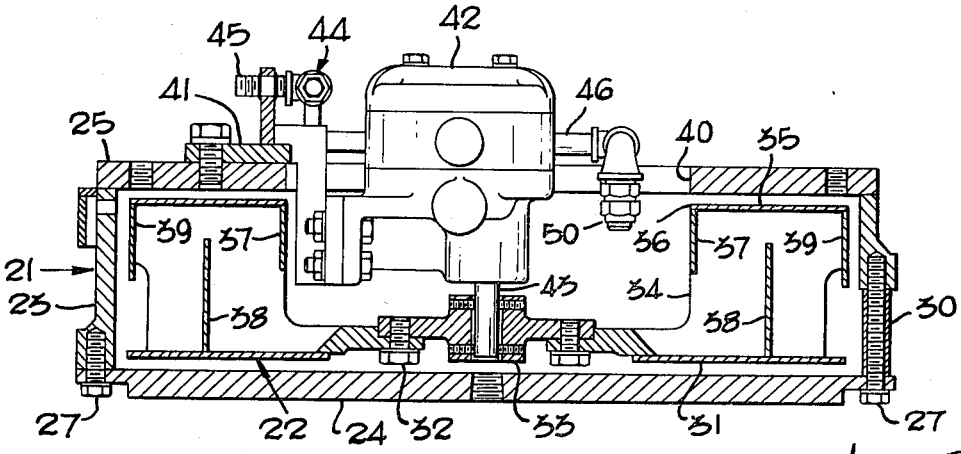
FIG. 4 is a cross-sectional view of the device shown in FIG. 3.

Referring now by characters of reference to the drawings, and first to FIGS. 1 and 2, it will be understood that the dust abatement device, generally indicated by 10 can be utilized with, but not limited to, a continuous mining machine referred to by 11. The dust abatement device 10 in FIGS. 1 and 2 is mounted on the continuous mining machine 11. Of course, it will be understood that the device can be built into the mining machine as original equipment. This combination of dust abatement device 10 and mining machine 11 are structurally related and functionally cooperate to remove material at the mine face and convey such material to a remote location, while at the same time process the polluted air substantially at the mine face by removing the dust.

The continuous mining machine illustrated in FIGS. 1 and 2 is conventional and is in widespread usage. Machine 11 includes a frame 12 mounted upon caterpillar treads 13. A pair of arms 14 are pivotally mounted onto the sides of the machine frame 12, the arms 14 rotatively mounting a cutter head 15. From FIG. 1, it is seen that the cutter head 15 includes a plurality of bits 16 disposed about the circumference of the head. As is usual, a drive means 17 is provided for rotating the cutter head 15 in a clockwise direction as viewed in FIG. 1, and a mechanism is provided for raising and lowering the arms 14 so that the head 15 can cut the mine face from the floor up to a predetermined height. Carried by the machine frame 12 and extending centrally of such machine along the longitudinal axis, is a conveyor 18. The conveyor 18 extends from substantially a point just rearwardly of the cutter head 15 to a location rearwardly of the mining machine 11. Also mounted at the sides of the front end of the mining machine 11 are a pair of material-gathering members 20 which move in unison toward and away from each other to gather material mined by the cutter head 15 and to place it onto the front end of conveyor 18.

In using the continuous mining machine 11, the operator manipulates the position of the cutter head 15 while such head is rotating, to cut material from a mine face. The machine 11 moves forwardly on its treads 13 as the head 15 cuts the mine face. The arms 14 are raised and lowered to provide a full height cut. The material mined is gathered by the members 20 rearwardly of the cutter head 15 and placed onto the conveyor 18, the conveyor 18 transporting the material rearwardly to a remote location where the material is placed in cars and subsequently transported out of the mine.

It will be understood, that the cutter head 15 acts on the material in a manner so as to create an area of dust concentration. The rotation of the cutter head 15 tends to cause an air flow rearwardly and upwardly from the area of dust concentration.

Figure 5:
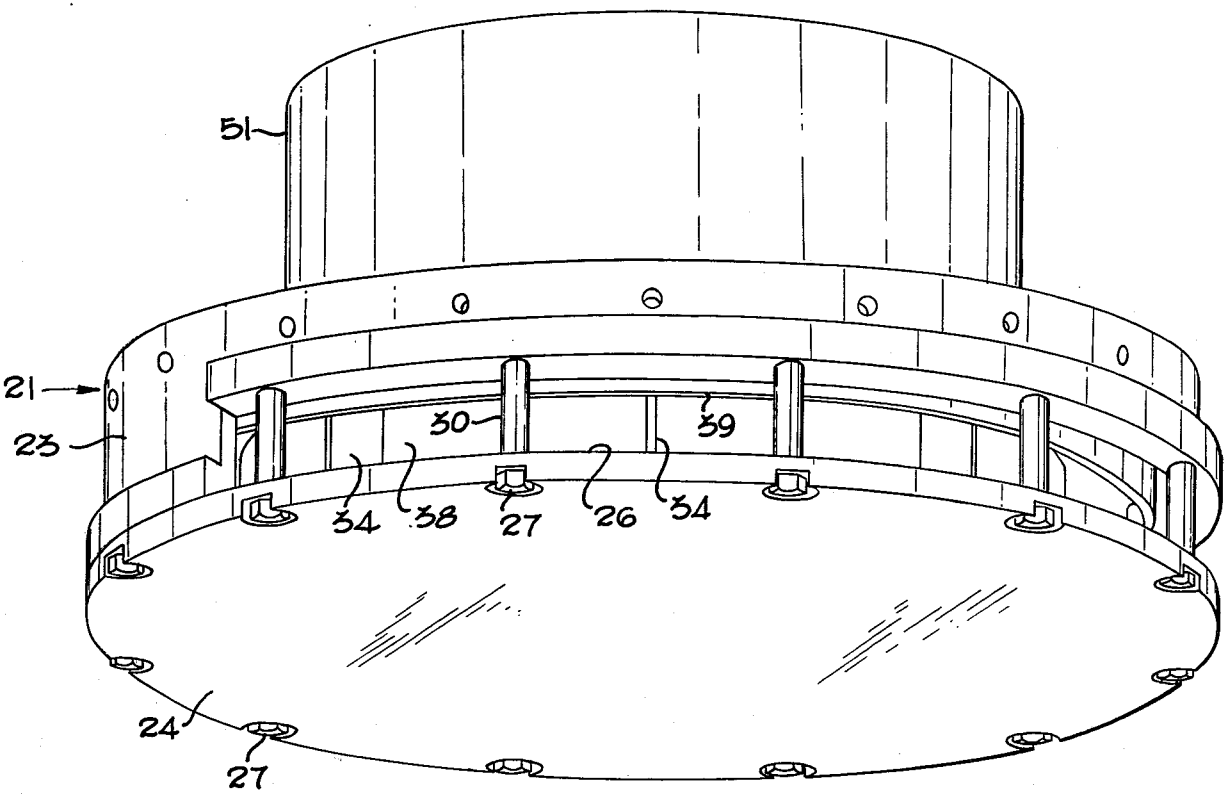
FIG. 5 is a bottom perspective view of the dust abatement device, showing the discharge port.

The dust abatement device 10 includes a circular housing 21 of relatively small height in which a rotor means including a fan 22, constituting a propulsion means, is mounted on a vertical axis. The rotor housing 21 includes a circular peripheral wall 23, a bottom wall 24, and a top wall 25. Formed in one side of the peripheral housing wall 23 is an elongate discharge port 26 which is more clearly shown in FIG. 5. A plurality of threaded bolts 27 secure the bottom wall 24 to the peripheral wall 23. Those bolts 27 that extend across the discharge port 26 are slightly longer and extend through spacer sleeves 30. The remaining portions of the housing construction will be described upon further detailed description of the rotor construction.

The fan 22 of the rotor means includes a circular bottom plate 31, the center portion of which is threadedly attached by bolts 32 to a hub 33. A plurality of angularly spaced, radial extending fan blades 34 are attached to the bottom plate 31 and extend outwardly from hub 33 to a location spaced just inwardly of the bottom plate periphery. Also, a top plate 35 is attached to the fan blades 34 and is disposed above the bottom plate 31, the bottom plate 31 and the top plate 35 being maintained in spaced relation by the fan blades 34 to provide a radial flow passage therebetween. The rotor top plate 35 is provided with a circular center opening 36 at the rotative axis of the rotor fan 22, the center opening 36 constituting an entrance to the radial flow passage of fan 22.

Disposed and retained by the fan 22 inside of the rotor flow passage, are a plurality of annular baffles 37, 38 and 39. These baffles can be perpendicular to the fan plates as shown or be inclined or be curved. These baffles 37–39 are retained in position by the radial fan blades 34, such baffles being located in slots formed in the fan blades 34. The annular baffle 37 extends downwardly from the top rotor plate 35 and into the flow passage adjacent the entrance opening 36. The baffle 38 is radially spaced outwardly from the baffle 37, and extends upwardly from the rotor plate 31. The baffle 39 is radially spaced outwardly from the baffles 38 and extends downwardly from the top rotor plate 35. These baffles 37–39 serve to deflect the liquid, air and pollutants such as dust into a transversely reversing, tortuous flow path as they move radially outward through the flow passage between the fan blades 34, and provide surfaces that serve to mix the dust with the liquid as will be described later.

The top housing plate 25 is provided with a center opening 40 that is aligned with the center opening 36 of fan 22. Mounted to the top housing plate 25 is a bracket 41 that extends into the housing 21 through the plate opening 40 and the fan opening 36. The bracket 41 serves to mount a hydraulic motor 42, the drive shaft 43 of which is attached to the fan hub 33.

A spray means generally indicated by 44 is carried by the bracket 41, the spray means 44 including an inlet pipe 45 that is connected by a T-fitting to a pair of pipe branches 46 and 47 extending substantially about the housing opening 40. Extending from each of the pipe branches 46 and 47 are a pair of spray nozzles 50, the nozzles 50 extending down into the housing 21 through the center openings 40 and 36. These spray nozzles 50 direct liquid such as water onto the fan 22, and particularly into the flow passage through the fan and onto the baffles 37–39 to provide wetted surfaces. These spray nozzles 50 spray the air-borne dry dust particulate as it moves through the entrance opening 36 and into the flow passage. The liquid saturates at least some of the particulate in the air and places such particulate in suspension with such liquid. The liquid, of course, can be sprayed into the flow passage at any place in the fan 22, not just at the entrance opening 36. In moving through the flow passage, the wetted baffles 37–39 engage the air and the dust particulate and mix the particulate in the liquid to provide a slurry.

The dust abatement device 10 includes a dust-collecting means, constituting an intake, which includes an upstanding circumferential flange 51 (FIG. 5) that is fixed to the top housing wall 25 and is located about the hydraulic motor 42 and the spray means 44.

As will be understood from FIGS. 1 and 2, the dust abatement device 10 is mounted on the machine frame 12 of the continuous miner at one side of the miner rearwardly of the cutter head 15. Although not shown, it will be understood that another dust abatement device is located at the opposite side of such machine. A duct 52, constituting a part of the dust-collecting means, extends from the flange 51 forwardly to an area just above and to the rear of the cutter head 15. The duct 52 diverges forwardly so that the duct of each dust abatement device covers approximately one half the longitudinal length of the cutter head 15. A plurality of intake ports 53 are formed in the bottom of the duct 52 at its forwardmost end. A plurality of internal directional partitions 54 are provided longitudinally of the duct 52 to direct flow from the intake ports 53 into the peripheral flange 51, and thence into the flow passage provided through the fan 22. The intake ports 53 are located at the area of dust concentration. Because of the air flow created by the rotation of cutter head 15, the intake ports 53 are located just above and behind the cutter head 15 and in the direction of the air flow.

The discharge port 26 of the dust abatement device is arranged to face forwardly so that the air and slurry propelled through the discharge port 26 by the fan 22 will be directed in a spray curtain toward the area of dust concentration. Because this device is mounted on a continuous miner, the air and slurry is directed in a spray curtain toward the cutter head 15, and particularly for a most efficient operation, in a direction toward the bottom portion of such cutter head 15 and in a direction counter to the direction of air flow created by such head 15, whereby to retard the air flow and movement of the dust particulate from the area of dust concentration. The slurry further wets the dry dust particulate at the area of dust concentration and acts to further reduce such concentration. In addition, this slurry in wetting such dry dust particulate tends to deposit the wetted particulate in the area between the collecting members 20 so that it is then deposited on the conveyor 18 for removal to a remote zone rearwardly of the machine.

It is thought that the operation and functional advantages of the dust abatement device and the method of dust abatement have become apparent from the foregoing detailed description of structure, but for completeness of disclosure, the operation and method will be briefly described.

As the fan 22 is rotated by the hydraulic motor 42, air-borne dry dust particulate is drawn into the intake ports 53 at the area of dust concentration and is delivered to the fan 22 through the duct 52, circumferential flange 51, and center openings 40 and 36. The spray nozzles 50 direct liquid directly onto the dry dust particulate and places at least a certain amount of such particulate in suspension with the liquid. In addition, and importantly, the liquid wets the surfaces provided by the baffles 37, 38 and 39. As the dry dust particulate moves in its tortuous path through the flow passage radially of the fan 22, such particulate will impinge on such wetted surfaces and such impingement will place the particulate in suspension with the liquid to provide a slurry. Obviously, because the dry dust particulate is removed from the air introduced into the fan 22, the air being discharged from the fan 22 is cleaner. The fan 22 propels the cleaner air and the slurry through the discharge port 26 forwardly in a direction toward and to the area of dust concentration located at the cutter head 15. This slurry wets the dry dust particulate at the area of concentration and acts to reduce such concentration. In addition, the air and slurry is directed in a spray curtain in a direction counter to the air flow created by the rotation of cutter head 15, and thereby acts to retard movement of the dust particulate away from the area of concentration.

The method of dust abatement includes the steps of collecting air-borne dry dust particulate from an area of dust concentration, delivering the air and particulate to a propulsion means provided by fan 22, spraying liquid on the propulsion means, mixing the liquid and dry dust particulate to provide a slurry, and delivering the cleaner air and slurry by the propulsion means in a spray to the area of dust concentration, the slurry further wetting the dry dust particulate at the area and reducing the concentration. The additional step of directing the air and slurry spray to the means that creates the area of dust concentration and substantially in a direction counter to any air flow created by the dust-forming means, retards such flow and the movement of the dry dust particulate away from the area of dust concentration.

We claim as our invention:

1. A machine and a dust abatement device, comprising:
   a. a machine including a cutter head for acting on material so as to create an area of dust concentration, and
   b. a dust abatement device on the machine located rearwardly of the cutter head, the device including:
      1. a propulsion means including a fan and a power means for rotating the fan,
      2. intake means for picking up and delivering air containing dry dust particulate from substantially the area of dust concentration to the fan,
      3. a discharge outlet means,
      4. means cooperating with the fan to provide a flow passage between the intake means and outlet means,
      5. spray means directing liquid on the fan,
      6. the fan including surfaces wetted by the liquid and located in the flow passage against which the dry dust particulate delivered to the fan impinges and is wetted to provide a slurry, and
      7. the fan discharging both the cleaner air and the slurry together from the fan and flow passage and through the outlet means in a spray.

2. A machine and dust abatement device as defined in claim 1, in which:
   c. the cutter head rotates in a direction to cause an air flow rearwardly and upwardly from the area of dust concentration, and
   d. both the cleaner air and slurry together are propelled by the fan through the outlet means substantially in a direction counter to the air flow created by the cutter head to retard such flow and movement of the dry dust particulate away from the area of dust concentration.

3. In a dust abatement device:
   a. a machine including a cutter head for acting on material so as to create an area of dust concentration,
   b. a dust abatement device on the machine located rearwardly of the cutter head, the device including:
      1. a propulsion means including a fan and a power means for rotating the fan,
      2. intake means for picking up and delivering air containing dry dust particulate from substantially the area of dust concentration to the fan,
      3. a discharge outlet means,
      4. means cooperating with the fan to provide a flow passage between the intake means and outlet means,
      5. spray means directing liquid on the fan,
      6. the fan including surfaces wetted by the liquid and located in the flow passage against which the dry dust particulate delivered to the fan impinges and is wetted to provide a slurry, and
      7. the fan discharging both the cleaner air and the slurry together from the fan and flow passage and through the outlet means in a spray,
   c. the cutter head rotating in a direction to cause an air flow rearwardly and upwardly from the area of dust concentration,
   d. both the cleaner air and slurry together being propelled by the fan through the outlet means substantially in a direction counter to the air flow created by the cutter head to retard such flow and movement of the dry dust particulate away from the area of dust concentration,
   e. the intake means including a duct extending from the propulsion means to the cutter head at the area of dust concentration to pick up and deliver airborne dry dust particulate from the area to the fan, and
   f. the fan propelling both the cleaner air and slurry together in a spray to the cutter head.

* * * * *